US010827277B2

(12) United States Patent
Lin et al.

(10) Patent No.: US 10,827,277 B2
(45) Date of Patent: Nov. 3, 2020

(54) THIN LOUDSPEAKER DEVICE

(71) Applicant: LUXSHARE-ICT CO., LTD., Taipei (TW)

(72) Inventors: You-Yu Lin, Taipei (TW); Chun-Yuan Chen, Taipei (TW); Che-Yi Hsiao, Taipei (TW); Hui-Yu Wang, Taipei (TW)

(73) Assignee: LUXSHARE-ICT CO., LTD., Taipei (TW)

( * ) Notice: Subject to any disclaimer, the term of this patent is extended or adjusted under 35 U.S.C. 154(b) by 0 days.

(21) Appl. No.: 16/529,392

(22) Filed: Aug. 1, 2019

(65) Prior Publication Data

US 2020/0221231 A1 Jul. 9, 2020

(30) Foreign Application Priority Data

Jan. 9, 2019 (TW) ..... 108100911 A

(51) Int. Cl.

| | |
|---|---|
| ***H04R 1/02*** | (2006.01) |
| ***H04R 9/06*** | (2006.01) |
| ***H04R 1/28*** | (2006.01) |
| *H04R 5/02* | (2006.01) |

(52) U.S. Cl.

CPC ..... *H04R 9/06* (2013.01); *H04R 1/025* (2013.01); *H04R 1/288* (2013.01); *H04R 5/02* (2013.01); *H04R 2420/07* (2013.01)

(58) Field of Classification Search

CPC ..... H04R 9/06; H04R 1/025; H04R 1/288; H04R 5/02; H04R 2420/07

USPC ..... 381/334, 357, 335

See application file for complete search history.

(56) References Cited

U.S. PATENT DOCUMENTS

| | | | | |
|---|---|---|---|---|
| 8,983,552 | B2 * | 3/2015 | Andersen | H04M 1/6066 455/569.1 |
| 2004/0190741 | A1 * | 9/2004 | Lopez | H04R 5/02 381/334 |
| 2014/0003622 | A1 * | 1/2014 | Ikizyan | H04S 7/301 381/95 |
| 2014/0355806 | A1 * | 12/2014 | Graff | H04R 1/2834 381/334 |
| 2015/0341711 | A1 * | 11/2015 | Chen | H04R 1/02 381/333 |

(Continued)

FOREIGN PATENT DOCUMENTS

| | | | |
|---|---|---|---|
| CN | 205584450 | U | 9/2016 |
| CN | 106101932 | A | 11/2016 |

(Continued)

*Primary Examiner* — Ammar T Hamid

(74) *Attorney, Agent, or Firm* — Birch, Stewart, Kolasch & Birch, LLP

(57) ABSTRACT

A thin loudspeaker device includes a housing, a battery, and a loudspeaker module. The battery and the loudspeaker module are located in the housing. The loudspeaker module includes an inner shell, two loudspeaker units, and a block wall. The two loudspeaker units are located in the inner shell. The two loudspeaker units are electrically connected to the battery. The block wall is located between the two loudspeaker units. The inner shell and the block wall jointly form two chambers and a channel. The channel is communicated with the two chambers. The two loudspeaker units are respectively located in the two chambers.

9 Claims, 7 Drawing Sheets

(56) References Cited

U.S. PATENT DOCUMENTS

2015/0382090 A1* 12/2015 Bisset ..... H04R 1/2857
381/386

FOREIGN PATENT DOCUMENTS

CN 106792287 A 5/2017
CN 207869358 U 9/2018

* cited by examiner

THIN LOUDSPEAKER DEVICE

CROSS-REFERENCE TO RELATED APPLICATION

This non-provisional application claims priority under 35 U.S.C. § 119(a) to Patent Application No. 108100911 filed in Taiwan, R.O.C. on Jan. 9, 2019, the entire contents of which are hereby incorporated by reference.

BACKGROUND

Technical Field

The present invention relates to a loudspeaker, and particularly to a thin loudspeaker device.

Related Art

There is a thin loudspeaker device which has light weight and small size. Compared with the traditional square and thick loudspeaker, the thickness of the thin loudspeaker device is significantly less than its length and width, so it has a flat shape in appearance, and therefore, it can be conveniently placed in a backpack or pocket, and can be carried about by a user and placed and used anywhere.

SUMMARY

Since the conventional thin loudspeaker device appeals for thinness and lightness, in order to fit a limited space, a loudspeaker module thereof is usually a flat driver. The operation power of such a flat driver is usually low, and the volume that can be generated is also limited, so a user often feels that the volume is insufficient in use. If a plurality of flat drivers are disposed in the loudspeaker module, the volume generated by the overall loudspeaker module can be increased, but the drivers will interfere with each other due to being too close, and the sound quality is affected.

In view of this, an object of the present invention is to provide a thin loudspeaker device. The thin loudspeaker device is expected to be kept thin and portable while generating sufficient volume, and various drivers do not interfere with each other during operation.

In an embodiment of the present invention, a thin loudspeaker device includes a housing, a battery and a loudspeaker module. The battery and the loudspeaker module are located in the housing. The loudspeaker module includes an inner shell, two loudspeaker units and a block wall. The two loudspeaker units are located in the inner shell. The two loudspeaker units are electrically connected to the battery. The block wall is located between the two loudspeaker units. The inner shell and the block wall jointly form two chambers and a channel. The channel is communicated with the two chambers. The two loudspeaker units are respectively located in the two chambers.

In an embodiment of the present invention, the loudspeaker module further includes a sound absorbing material, the sound absorbing material is disposed in the two chambers and located around the two loudspeaker units, and the sound absorbing material extends into the channel.

In summary, according to the embodiments of the thin loudspeaker device provided by the present invention, the thin loudspeaker device can generate sufficient volume by disposing a plurality of loudspeaker units in a single loudspeaker module while being kept light and portable, and through the anti-interference design of the inner shell, the loudspeaker units do not interfere with each other during operation, thereby improving the sound quality.

The detailed features and advantages of the present invention are set forth in the detailed description of the following embodiments of the present invention, the content of which is sufficient for any person skilled in the art to understand the technical content of the present invention and implement it based thereon. According to the contents, the claims and the drawings disclosed in this description, any person skilled in the art can easily understand the objects and advantages associated with the present invention.

DETAILED DESCRIPTION

Figure 1:
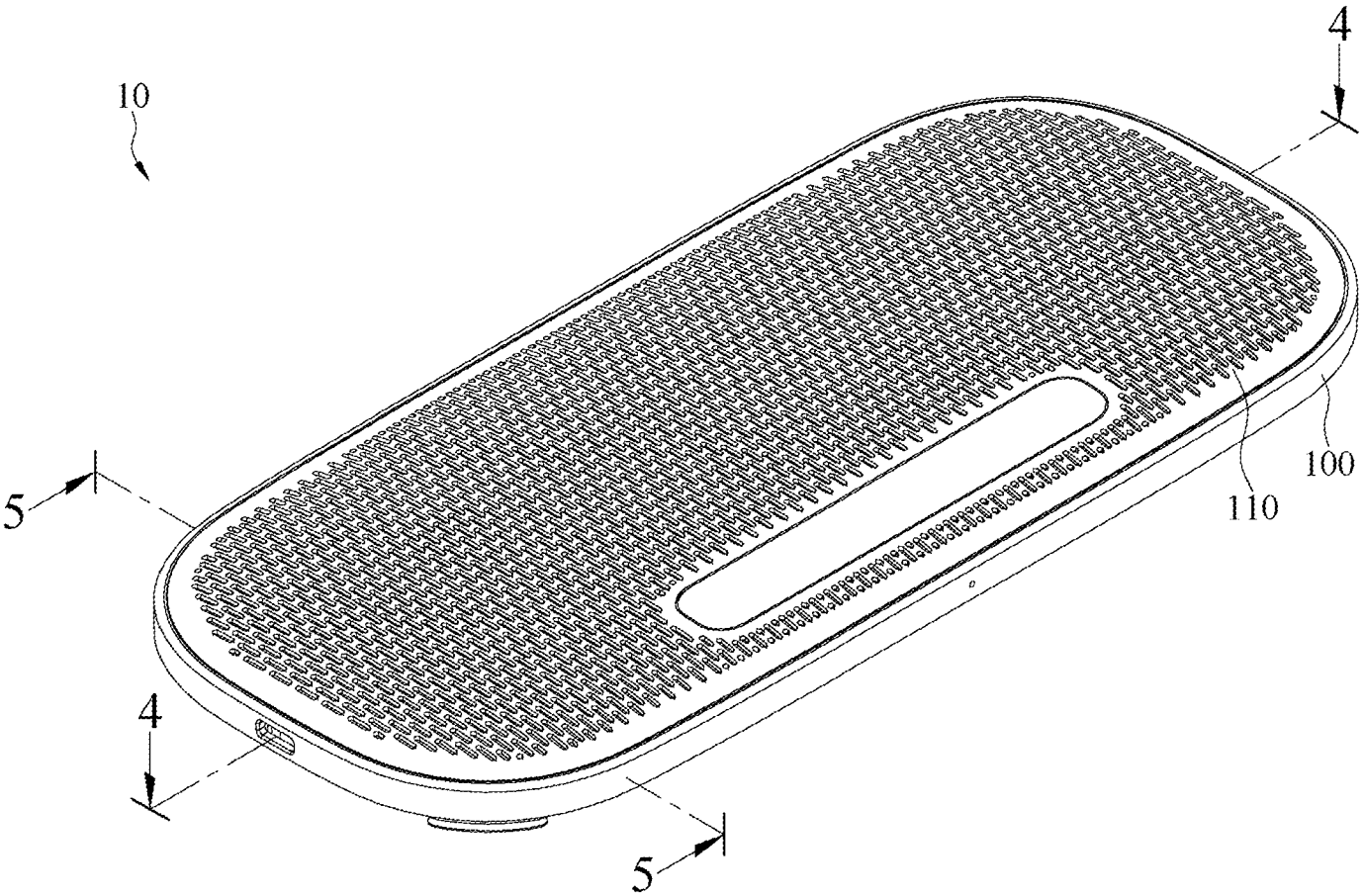
FIG. 1 is a schematic view of a thin loudspeaker device according to an embodiment of the present invention.
Figure 2:
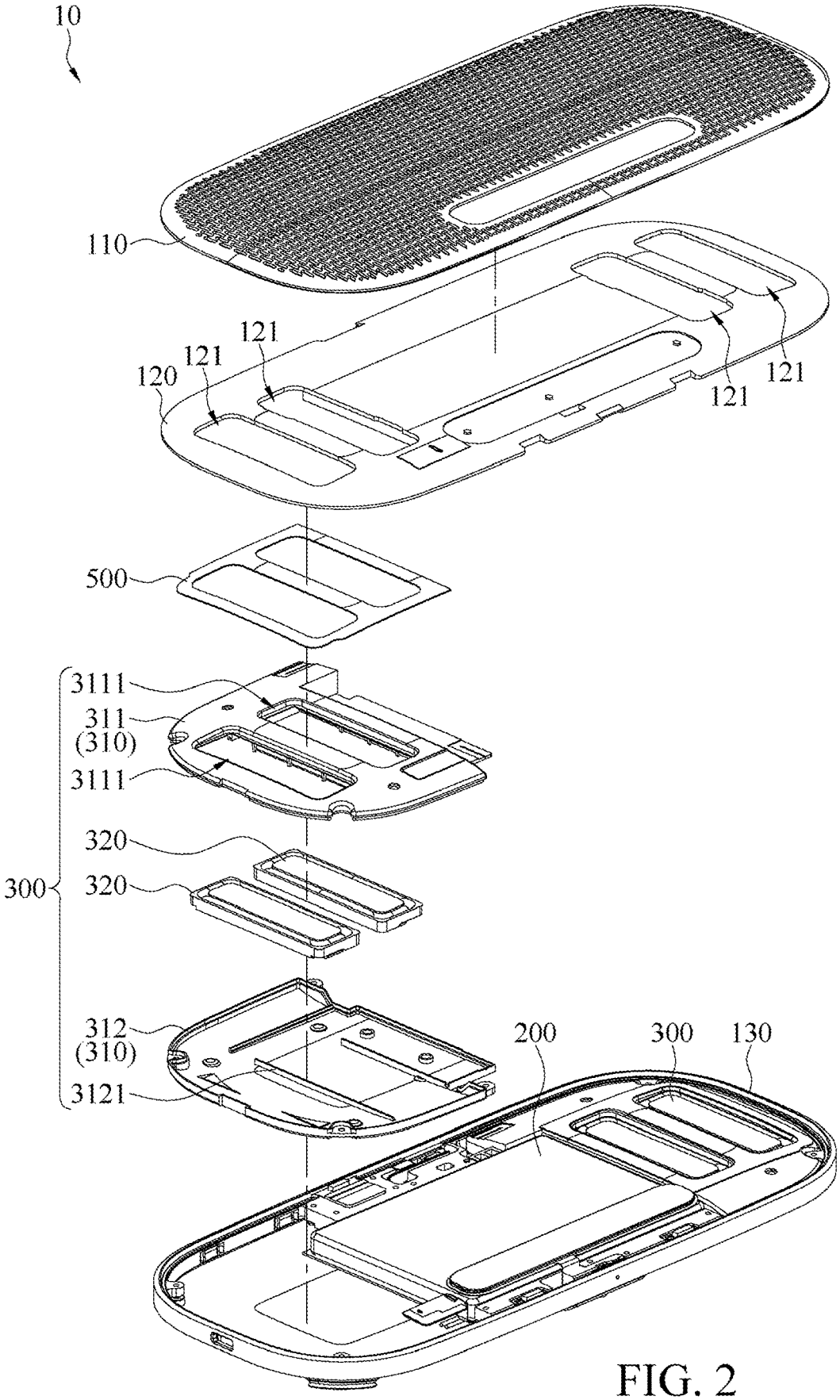
FIG. 2 is a partial exploded schematic view of the thin loudspeaker device of FIG. 1.

Referring to FIG. 1 and FIG. 2, FIG. 1 is a schematic view of a thin loudspeaker device 10 according to an embodiment of the present invention, and FIG. 2 is a partial exploded schematic view of the thin loudspeaker device 10 of FIG. 1. As shown in FIG. 1, in the present embodiment, the thin loudspeaker device 10 is of a thin design, so that its appearance thickness is remarkably less than its length and width, and this design is advantageous for carrying. As shown in FIG. 2, the thin loudspeaker device 10 includes a housing 100, a battery 200 and a loudspeaker module 300, and the battery 200 and the loudspeaker module 300 are both located in the housing 100. In the present embodiment, the number of the loudspeaker module 300 is two, the two loudspeaker modules 300 are symmetrically disposed on two opposite sides of the housing 100, and the battery 200 is located between the two loudspeaker modules 300. In other embodiments, the number of the loudspeaker module 300 may be only one; alternatively, the number of the loudspeaker module 300 may be three or more. The following is mainly described for one of the loudspeaker modules 300 of the present embodiment, and the structure and components of the other loudspeaker module 300 are the same and are symmetric to the illustrated loudspeaker module 300.

As shown in FIG. 2, in the present embodiment, the housing 100 includes a mesh cover 110, a top shell 120 and a bottom shell 130. The top shell 120 and the bottom shell 130 are in fixed butt joint with each other, and the top shell 120 and the bottom shell 130 jointly enclose the loudspeaker module 300 and the battery 200. The top shell 120 includes a plurality of top openings 121, the top openings 121 penetrate the top shell 120, and the sound generated by the loudspeaker module 300 can be transmitted to the outside through the top openings 121. The mesh cover 110 is disposed on a surface, away from the bottom shell 130, of the top shell 120, and the mesh cover 110 can cover the top openings 121, so that foreign matter can be prevented from entering the housing 100.

As shown in FIG. 2, in the present embodiment, each of the loudspeaker modules 300 includes an inner shell 310 and at least two loudspeaker units 320. The two loudspeaker units 320 are disposed in the inner shell 310, and the two loudspeaker units 320 are electrically connected to the battery 200. In the present embodiment, the specifications of the two loudspeaker units 320 are the same, but are not limited thereto. In operation, the two loudspeaker units 320 can jointly generate sounds to produce sufficient volume. In other embodiments, each loudspeaker module 300 may include three or more loudspeaker units 320. In the present embodiment, the inner shell 310 includes an upper shell 311 and a lower shell 312, the upper shell 311 and the lower shell 312 are in fixed butt joint with each other, and the two loudspeaker units 320 are located between the upper shell 311 and the lower shell 312. Further, the upper shell 311 includes two upper openings 3111, and the two loudspeaker units 320 are respectively disposed corresponding to the two upper openings 3111. That is, each of the loudspeaker units 320 is respectively aligned with the corresponding upper opening 3111, and each of the upper openings 3111 is respectively aligned with the corresponding top opening 121.

Figure 3:
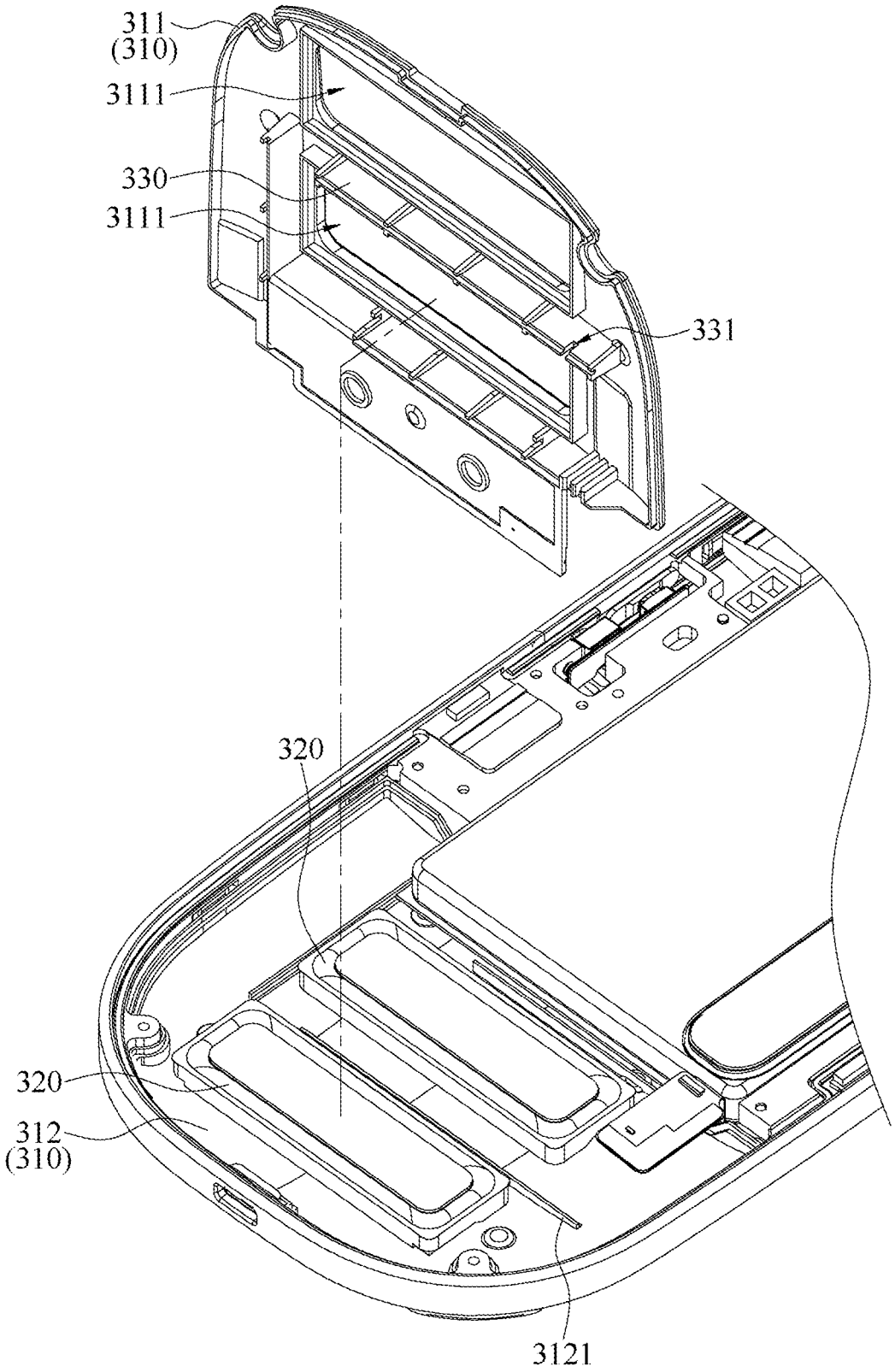
FIG. 3 is a partial exploded schematic view of the thin loudspeaker device of FIG. 1, where a mesh cover and a top shell are omitted and an upper shell is rotated by 90 degrees to show the inner structure.
Figure 4:
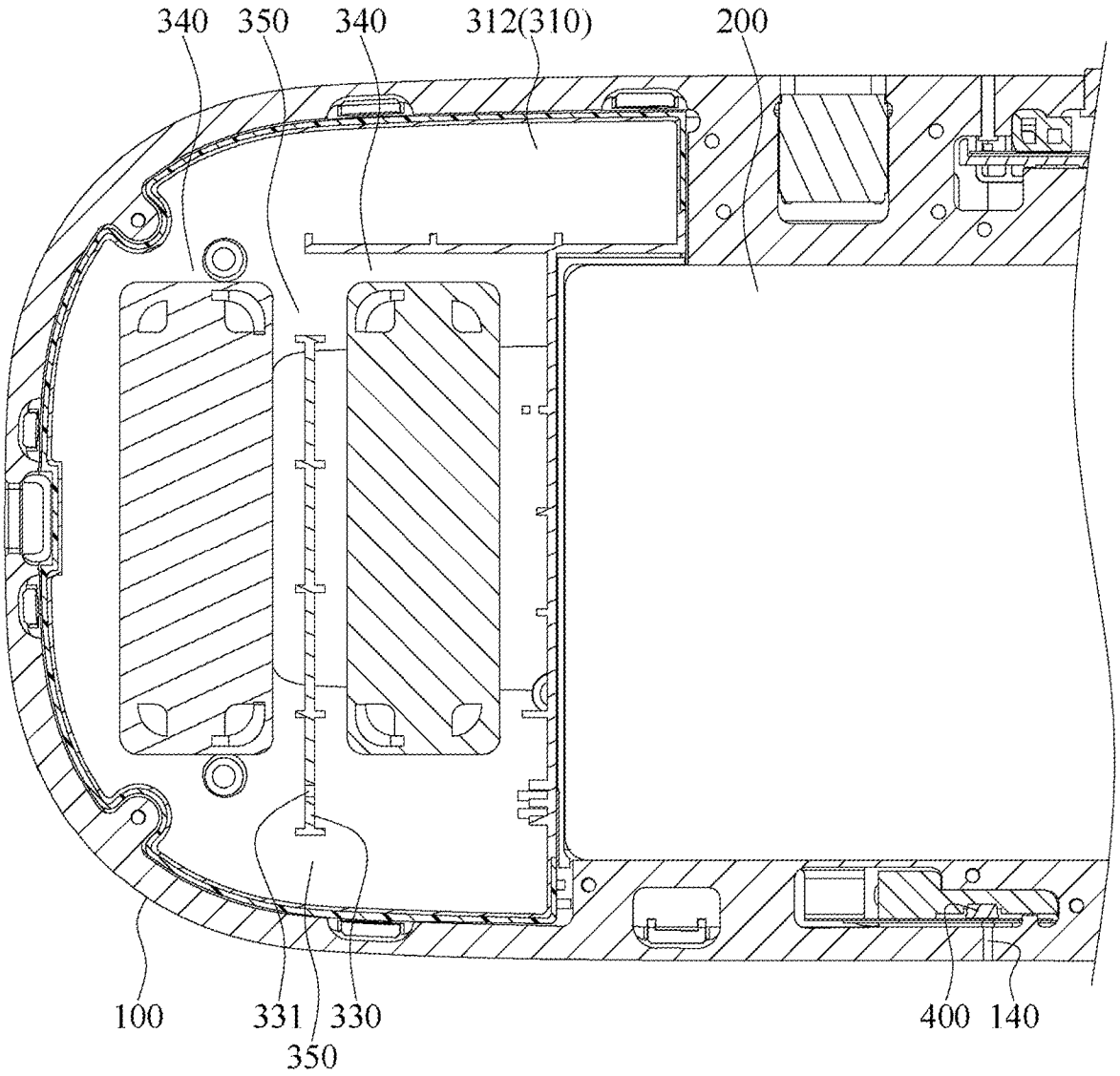
FIG. 4 is a partial cross-sectional schematic view of FIG. 1 taken along line 4-4.

Referring to FIG. 3 and FIG. 4, FIG. 3 is a partial exploded schematic view of the thin loudspeaker device 10 of FIG. 1, and FIG. 4 is a partial cross-sectional schematic view of FIG. 1 taken along line 4-4, where a mesh cover 110 and a top shell 120 of the housing 100 are omitted in FIG. 3 and an upper shell 311 of the inner shell 310 is rotated by 90 degrees to show the inner structure. As shown in FIG. 3 and FIG. 4, in the present embodiment, the loudspeaker module 300 further includes a block wall 330, the block wall 330 is disposed between the two loudspeaker units 320, and the inner shell 310 and the block wall 330 jointly form two chambers 340 and a channel 350. The channel 350 is communicated with the two chambers 340, and the two loudspeaker units 320 are respectively located in the two chambers 340.

As shown in FIG. 4, in the present embodiment, the two loudspeaker units 320 are disposed side by side and adjacent to each other, and the block wall 330 divides the inner shell 310 into the two adjacent chambers 340, so that the two loudspeaker units 320 are not located in the same space, and the block wall 330 is structurally blocked between the two loudspeaker units 320. For example, the block wall 330 separates the two loudspeaker units 320 in the traversal (horizontal) direction as seen in FIG. 4. Thereby, when the two loudspeaker units 320 jointly generate a sound, the sound of each loudspeaker unit 320 is transmitted to the outside through the respective aligned upper opening 3111 and top opening 121. As a result, the sounds generated by the two loudspeaker units 320 in the same loudspeaker module 300 do not adversely affect the sound quality due to mutual interference or standing waves.

Considering that the inner shell 310 of the loudspeaker module 300 may have a non-fully symmetrical structure for being matched with the housing 100, this may result in the shape, volume and geometry of the two chambers 340 in the inner shell 310 not being exactly the same. In this case, if the two chambers 340 are completely separated from each other, the loudspeaker units 320 respectively located in the two chambers 340 may have different resonance frequencies during operation, resulting in inconsistent frequency response ranges, and thus the sound quality is adversely affected. Therefore, as shown in FIG. 3 and FIG. 4, in the present embodiment, the block wall 330 substantially blocks the two adjacent loudspeaker units 320 in the traversal direction as viewed in FIG. 4, but does not completely block them. For example, a gap may be formed between the block wall 330 and the inner shell 310, and the gap may serve as a channel 350 being communicated with the two adjacent chambers 340. For example, a distance between the upper side of the block wall 330 and the inner shell 310 forms the channel 350 as viewed in FIG. 4, and due to the presence of the channel 350, parts of the two adjacent loudspeaker units 320 are not blocked in the traversal direction. The channel 350 allows the sounds produced by the two loudspeaker units 320 to communicate with each other to a certain extent, whereby each of loudspeaker units 320 in the inner shell 310 shares the communicated chambers 340 on average, the resonance frequencies of the loudspeaker units 320 in the inner shell 310 are the same, and the frequency response ranges of the loudspeaker units 320 tend to be consistent.

In the present embodiment, the number of the channels 350 is two, and the two channels 350 are located on the upper side and the lower side of the block wall 330 as viewed in FIG. 4, but are not limited thereto. In other embodiments, the number of the channel 350 may be only one, which is located on the upper side, the lower side or the middle of the block wall 330 as viewed in FIG. 4, or the number of the channel 350 may be three or more. In other embodiments, there may be no gap between the block wall 330 and the inner shell 310, but the block wall 330 itself may be provided with one or more holes therethrough to achieve the effect of the channel 350 described above.

Figure 5:
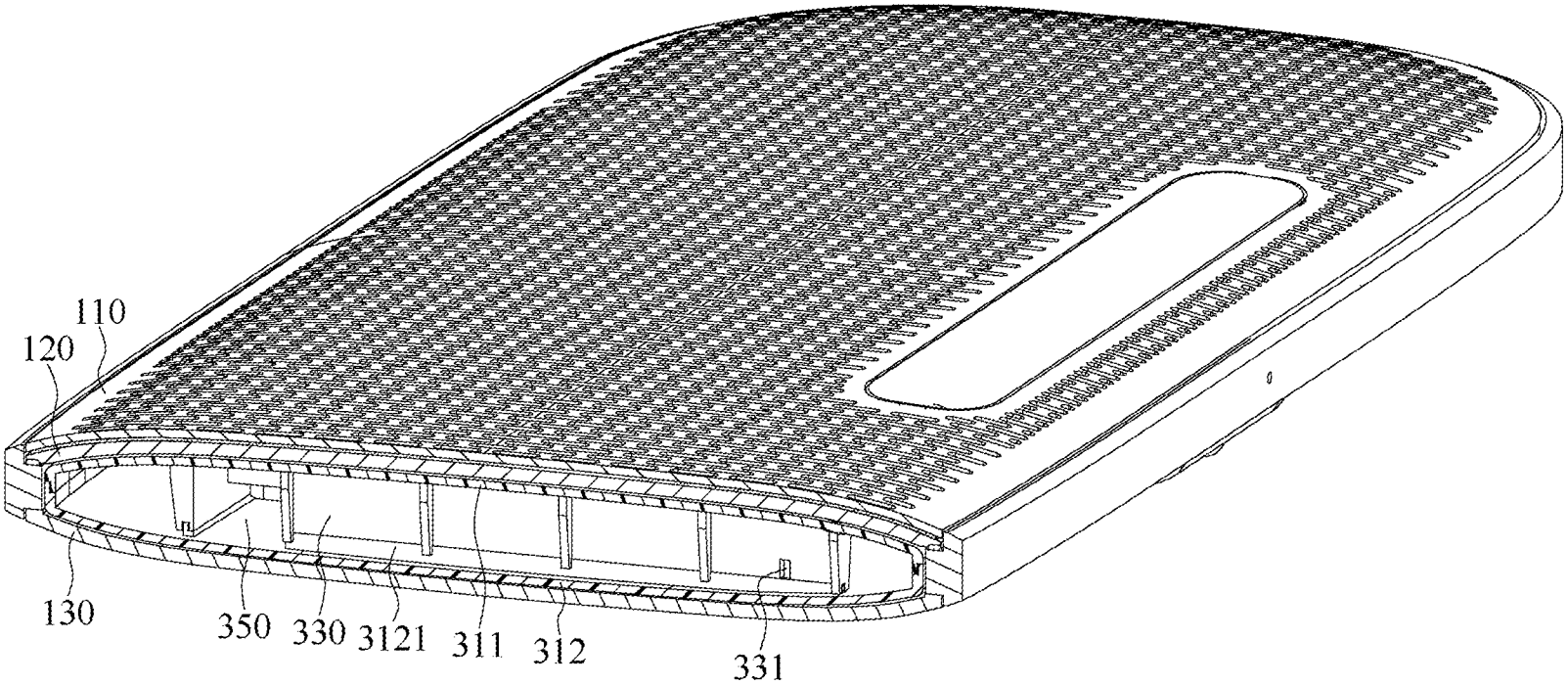
FIG. 5 is a partial cross-sectional schematic view of FIG. 1 taken along line 5-5.

Referring to FIG. 5, FIG. 5 is a partial cross-sectional schematic view of FIG. 1 taken along line 5-5. As shown in FIG. 3 and FIG. 5, in the present embodiment, the block wall 330 protrudes from the upper shell 311, and therefore, when the upper shell 311 and the lower shell 312 are butted against each other, the block wall 330 located in the upper shell 311 contacts the lower shell 312 to partition the two chambers 340. In the present embodiment, the block wall 330 is integrally formed with the upper shell 311, but is not limited thereto. As shown in FIG. 3 to FIG. 5, the block wall 330 has a threading opening 331, the threading opening 331 penetrates through an edge, adjacent to the lower shell 312, of the block wall 330, and the threading opening 331 is used for passing a wire (not shown in the FIGs) of the loudspeaker unit 320 so that the wire can be connected to the battery 200. Moreover, the threading opening 331 also has a function of fixing the wire, so that the wire does not swing in the inner shell 310.

As shown in FIG. 2, FIG. 3 and FIG. 5, in the present embodiment, a rib 3121 protrudes from the lower shell 312, and the rib 3121 of the lower shell 312 and the block wall 330 of the upper shell 311 are corresponding to each other. When the upper shell 311 is butted against the lower shell 312, the rib 3121 and the block wall 330 abut against each other to jointly partition the two chambers 340. In addition, the block wall 330 and the rib 3121 also help to increase the mechanical strength of the upper shell 311 and the lower shell 312, making the overall thin loudspeaker device 10 more robust and less deformable.

Figure 6:
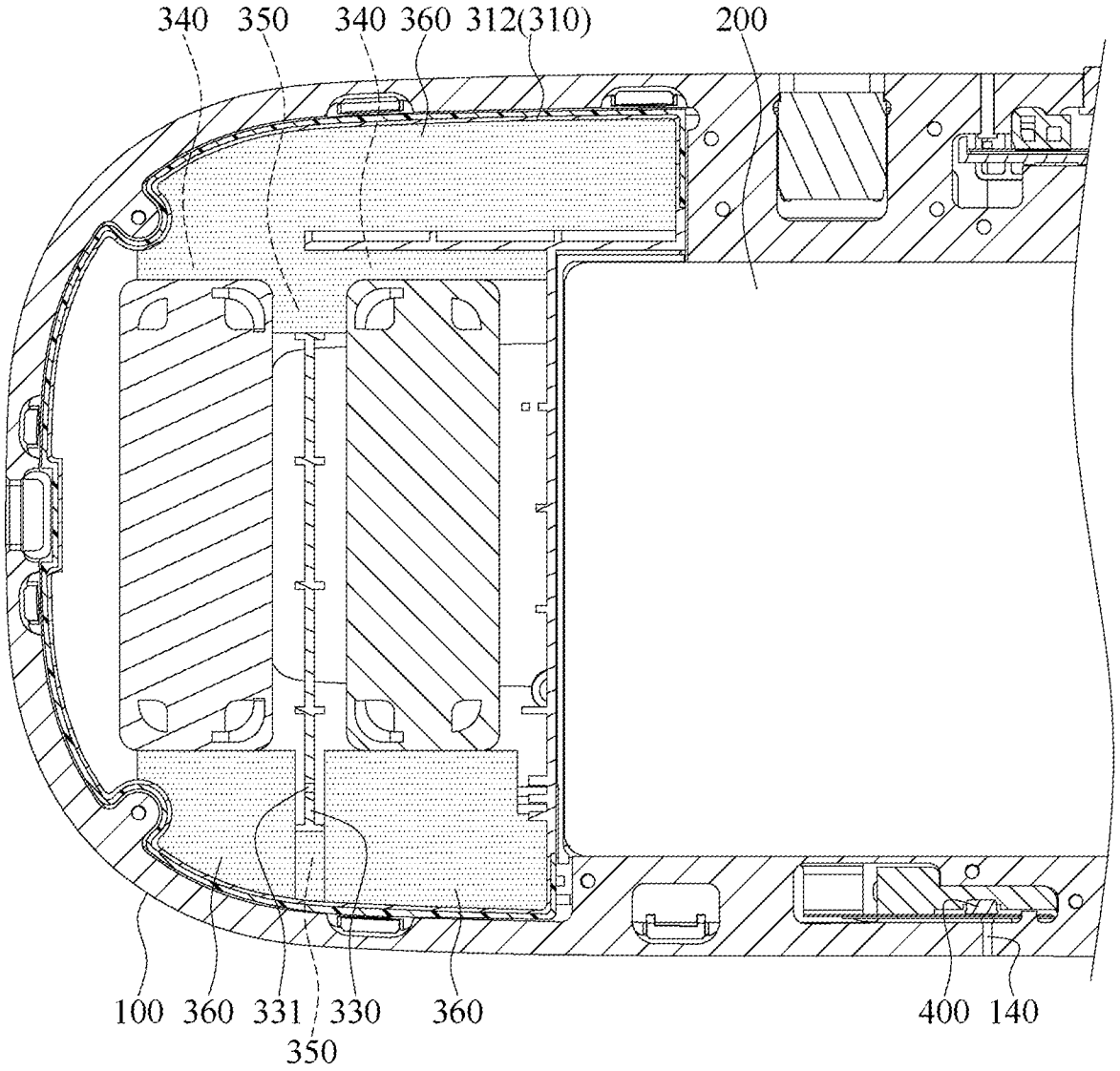
FIG. 6 is a partial cross-sectional schematic view of a thin loudspeaker device according to another embodiment of the present invention.

Referring to FIG. 6, FIG. 6 is a partial cross-sectional schematic view of a thin loudspeaker device 10 according to another embodiment of the present invention. The difference between the embodiment of FIG. 6 and the embodiment of FIG. 4 is that the loudspeaker module 300 of FIG. 6 further includes a sound absorbing material 360, and the sound absorbing material 360 is disposed in the two chambers 340 and located around the two loudspeaker units 320. In other words, the sound absorbing material 360 is disposed between the loudspeaker unit 320 and the inner shell 310. In the present embodiment, the sound absorbing material 360 also extends into the channel 350, that is, the channel 350 is filled with the sound absorbing material 360. Thus, when the two loudspeaker units 320 of the loudspeaker module 300 make a sound, the sounds communicate with each other through the sound absorbing material 360 of the channel 350 to a certain extent. The sound absorbing material 360 can effectively eliminate standing waves, thereby improving the sound quality. In the present embodiment, the sound absorbing material 360 is sound absorbing cotton, but is not limited thereto.

As shown in FIG. 4 and FIG. 6, in the present embodiment, the thin loudspeaker device 10 further includes a sound receiving unit 400, the housing 100 includes a sound receiving hole 140, the sound receiving unit 400 is located in the housing 100, and the sound receiving unit 400 is disposed corresponding to the sound receiving hole 140. The sound receiving unit 400 can receive the sound of the outside through the sound receiving hole 140. In the present embodiment, the distance between the sound receiving unit 400 and the closer one of the two loudspeaker units 320 of the loudspeaker module 300 is greater than or equal to 10 mm. That is, the distance between the sound receiving unit 400 and any of the loudspeaker units 320 of any of the loudspeaker modules 300 needs to be greater than or equal to 10 mm. Also, this distance can be defined as the shortest linear distance between the sound receiving unit 400 and the loudspeaker unit 320. The design of the distance can prevent the sound receiving unit 400 and the loudspeaker unit 320 from interfering with each other during operation.

In the present embodiment, the sound receiving unit 400 is located between the two loudspeaker modules 300 and adjacent to the middle of the lower side of the housing 100 as viewed in FIG. 4 and FIG. 6. In other embodiments, the sound receiving unit 400 may be located between the two loudspeaker modules 300 and adjacent to the middle of the upper side of the housing 100 as viewed in FIG. 4 and FIG. 6; alternatively, the sound receiving unit 400 may be adjacent to any side of the housing 100 and offset from the middle; alternatively, the sound receiving unit 400 may also be relatively close to one of the loudspeaker modules 300. In other embodiments, the sound receiving unit 400 and the corresponding sound receiving hole 140 may be plural, and the plurality of sound receiving units 400 may be located between the two loudspeaker modules 300 and respectively adjacent to the upper side and lower side of the housing 100 as viewed in FIG. 4 and FIG. 6. For example, the number of the sound receiving unit 400 may be two, and the two sound receiving units 400 are symmetrically disposed on two opposite sides in the housing 100 (e.g., adjacent to the upper side and the lower side of the housing 100 as viewed in FIG. 4 and FIG. 6). Further, in the case where there are a plurality of the sound receiving units 400, the distance between any two of the sound receiving units 400 is greater than or equal to 10 mm. That is, the distance between the two closest sound receiving units 400 needs to be greater than or equal to 10 mm, thereby preventing the plurality of sound receiving units 400 from interfering with each other during operation.

As shown in FIG. 2, in the present embodiment, the thin loudspeaker device 10 further includes a foam 500, the foam 500 is disposed between the inner shell 310 and the housing 100, and the vibration of the inner shell 310 and the housing 100 can be reduced through the foam 500, so that the vibration generated by the loudspeaker module 300 during operation can be absorbed by the foam 500 without being easily transmitted to the housing 100. In the present embodiment, the foam 500 is disposed between the upper shell 311 and the top shell 120, and the foam 500 is adhesively fixed to the upper shell 311 and the top shell 120 contacts the foam 500.

As shown in FIG. 2 to FIG. 4 and FIG. 6, in the present embodiment, the loudspeaker unit 320 is a flat driver. Compared to a typical conical driver, the appearance thickness of the flat driver is remarkably less than its length and width. Due to the flat shape of the loudspeaker unit 320, the loudspeaker module 300 can be designed to be flatter, and jointly, the overall thin loudspeaker device 10 can be designed to be flatter. Although the volume that can be produced by the flat driver is more limited than that of the conical driver, since the plurality of loudspeaker units 320 can be disposed in the single loudspeaker module 300 of the thin loudspeaker device 10, the thin loudspeaker device 10 can still output sufficient volume in an overall thin and flat design.

In the present embodiment, the loudspeaker unit 320 is a rectangular flat driver. The rectangular flat driver may be defined as that the outline shape of the projection surface of the loudspeaker unit 320 in the main sounding direction is a rectangle. For example, the loudspeaker unit 320 as shown in FIG. 4 or FIG. 6 can be regarded as its outline shape of the projection surface in the main sounding direction (i.e., the direction in which the loudspeaker unit 320 is aligned with the upper opening 3111 and the top opening 121), and this outline shape is rectangular. In other embodiments, the loudspeaker unit 320 can also be a square flat driver or a circular flat driver.

Figure 7:
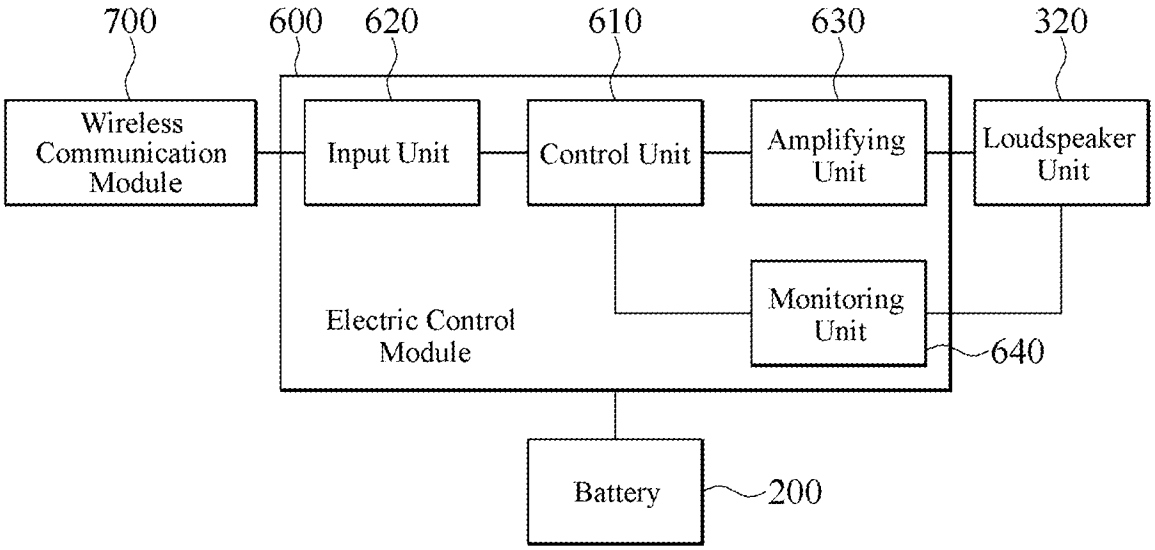
FIG. 7 is a block schematic diagram of an electric control module of a thin loudspeaker device according to an embodiment of the present invention.

Referring to FIG. 7, FIG. 7 is a block schematic diagram of an electric control module 600 of a thin loudspeaker device 10 according to an embodiment of the present invention. In the present embodiment, the thin loudspeaker device 10 further includes the electric control module 600, and the electric control module 600 may be integrated into a circuit board or a chip and disposed in the housing 100, but is not limited thereto. In other embodiments, the electric control module 600 may also be an external component located outside the housing 100, and the electric control module 600 can be signally connected to the electronic components in the thin loudspeaker device 10 in a wired or wireless manner. For example, the electric control module 600 may be a functional module in a smart phone. Since the loudspeaker unit 320 adopts a flat driver to facilitate a thin design, accordingly, the loudspeaker unit 320 is relatively easily damaged due to excessive voltage or current, so the electric control module 600 can adjust the voltage or current output to the loudspeaker unit 320 in real time to protect the loudspeaker unit 320.

As shown in FIG. 7, in the present embodiment, the electric control module 600 is electrically connected to the battery 200, and the electric control module 600 includes a control unit 610, an input unit 620, an amplifying unit 630 and a monitoring unit 640. The control unit 610 is electrically connected to the input unit 620, the amplifying unit 630 and the monitoring unit 640, and the amplifying unit 630 and the monitoring unit 640 are electrically connected to the loudspeaker unit 320. When the thin loudspeaker device 10 is in operation, the input unit 620 receives an audio initial signal, and the control unit 610 controls the amplification amplitude of the amplifying unit 630 to amplify the initial signal, so that the amplifying unit 630 outputs the amplified signal after the initial signal is amplified. After the amplified signal is transmitted to the loudspeaker unit 320, the loudspeaker unit 320 is driven to generate a sound. The monitoring unit 640 continuously detects the amplitude of the amplified signal received by the loudspeaker unit 320, and the amplitude is, for example, a value corresponding to the current or voltage. Moreover, the monitoring unit 640 generates a feedback signal according to the amplitude, and transmits the feedback signal to the control unit 610. According to the feedback signal, the control unit 610 determines whether it is necessary to adjust the amplification amplitude in real time. For example, if the amplitude exceeds a certain threshold, the control unit 610 reduces the amplification amplitude in real time according to the feedback signal of the monitoring unit 640, so that the amplitude of the amplified signal is reduced to prevent the loudspeaker unit 320 from being damaged due to excessive current or voltage.

As shown in FIG. 7, in the present embodiment, the thin loudspeaker device 10 further includes a wireless communication module 700, and the wireless communication module 700 is electrically connected to the battery 200 and the loudspeaker unit 320. The thin loudspeaker device 10 can receive the wireless audio signal through the wireless communication module 700 and generate a sound corresponding to the wireless audio signal through the loudspeaker unit 320. In addition, the audio signal generated by the sound receiving unit 400 corresponding to the received sound may also be wirelessly output through the wireless communication module 700. For example, the thin loudspeaker device 10 can be connected to a smart phone through signals of the wireless communication module 700, and the music played by the smart phone can be played through the thin loudspeaker device 10. Besides, when a user makes a call or conducts voice communication with the smart phone, the user can also send and receive voice through the thin loudspeaker device 10. In the present embodiment, the wireless communication module 700 is a Bluetooth communication module, but is not limited thereto. In the present embodiment, the wireless communication module 700 is electrically connected to the input unit 620 of the electric control module 600, that is, the input unit 620 can receive the audio initial signal through the wireless communication module 700.

In summary, according to the embodiments of the thin loudspeaker device provided by the present invention, the thin loudspeaker device can generate sufficient volume by disposing a plurality of loudspeaker units in a single loudspeaker module while being kept light and portable. Besides, the inner shell is provided with the block wall, and the block wall is blocked between the two adjacent loudspeaker units to prevent the loudspeaker units from interfering with each other during operation. The inner shell has a channel, and the channel can be communicated with the two adjacent chambers blocked by the block wall, so the resonance frequency of each loudspeaker unit in the loudspeaker module tends to be consistent. In addition, the chambers and the channel are filled with the sound absorbing material, which helps to prevent interference and eliminate standing waves, and can effectively improve the sound quality.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A thin loudspeaker device, comprising:
a housing;
a battery, located in the housing; and
a loudspeaker module, located in the housing, wherein the loudspeaker module comprises:
an inner shell, comprising an upper shell and a lower shell;
two loudspeaker units, located in the inner shell and located between the upper shell and the lower shell, wherein the two loudspeaker units are electrically connected to the battery;
a block wall, located between the two loudspeaker units, wherein the block wall protrudes from the upper shell, the inner shell and the block wall jointly form two chambers and a channel, the channel is communicated with the two chambers, and the two loudspeaker units are respectively located in the two chambers; and
a rib, protruding from the lower shell and abutting against the block wall.

2. The thin loudspeaker device according to claim 1, wherein the loudspeaker module further comprises a sound absorbing material, the sound absorbing material is disposed in the two chambers and located around the two loudspeaker units, and the sound absorbing material extends into the channel.

3. The thin loudspeaker device according to claim 1, wherein the upper shell comprises two upper openings, and the two loudspeaker units are disposed respectively corresponding to the two uppers openings.

4. The thin loudspeaker device according to claim 1, further comprising a sound receiving unit, wherein the housing comprises a sound receiving hole, the sound receiving unit is located in the housing and disposed corresponding to the sound receiving hole, and the distance between the sound receiving unit and any of the two loudspeaker units is greater than or equal to 10 mm.

5. The thin loudspeaker device according to claim 4, wherein the number of the sound receiving units is two, the two sound receiving units are symmetrically disposed on two opposite sides in the housing, and the distance between the two sound receiving units is greater than or equal to 10 mm.

6. The thin loudspeaker device according to claim 1, wherein the number of the loudspeaker modules is two, the two loudspeaker modules are symmetrically disposed on two opposite sides in the housing, and the battery is located between the two loudspeaker modules.

7. The thin loudspeaker device according to claim 1, wherein the loudspeaker units are rectangular flat drivers, square flat drivers or circular flat drivers.

8. The thin loudspeaker device according to claim 1, further comprising an electric control module, wherein the electric control module is electrically connected to the battery and comprises a control unit, an input unit, an amplifying unit and a monitoring unit, the control unit is electrically connected to the input unit, the amplifying unit and the monitoring unit, the amplifying unit and the monitoring unit are electrically connected to the loudspeaker units, the input unit receives an initial signal, the control unit controls the amplifying unit to amplify the initial signal according to an amplification amplitude and output an amplified signal, the monitoring unit detects an amplitude of the amplified signal received by the loudspeaker units and transmits a feedback signal to the control unit according to the amplitude, and the control unit adjusts the amplification amplitude according to the feedback signal.

9. The thin loudspeaker device according to claim 1, further comprising a wireless communication module, wherein the wireless communication module is electrically connected to the battery and the loudspeaker units.

* * * * *